United States Patent [19]

Weir

[11] Patent Number: 4,726,556

[45] Date of Patent: Feb. 23, 1988

[54] HOLDER TABLE

[76] Inventor: Stanley M. Weir, P.O. Box 365, Santa Clara, Calif. 95052

[21] Appl. No.: 823,028

[22] Filed: Jan. 27, 1986

[51] Int. Cl.[4] ..... A47G 97/04

[52] U.S. Cl. ..... 248/454; 248/460; 269/289 R

[58] Field of Search ..... 269/289 R; 248/451, 248/452, 453, 456, 462–465, 448, 449, 277, 280.1, 281.1, 291, 454, 460; 108/2, 5, 6, 10

[56] References Cited

U.S. PATENT DOCUMENTS

| | | | |
|---|---|---|---|
| 683,724 | 10/1901 | Carr | 248/453 |
| 696,993 | 4/1902 | Mills | 248/462 |
| 1,359,811 | 11/1920 | Kerkendall et al. | 248/462 |
| 2,244,773 | 6/1941 | Hawk | 248/451 |
| 2,563,671 | 8/1951 | Basinger | 248/456 |
| 3,505,515 | 4/1970 | Adra | 248/291 |
| 3,747,889 | 7/1973 | Gerald | 248/451 |
| 4,036,465 | 7/1977 | Kellner | 248/463 |
| 4,196,674 | 4/1980 | Van Laarhouen | 248/456 |

*Primary Examiner*—Frederick R. Schmidt
*Assistant Examiner*—Judy J. Hartman

[57] ABSTRACT

Across the surface and around two opposite sides of a table top are looped two elastic hold down straps. A third elastic hold down strap is looped around these two straps and the other two sides of the table top. Lips grip an edge of the table top. The table top is slidably mounted on rails held parallel by two parallel supports each pivotally connected to ends of arms. The arms are pivotally connected at their other ends to a shaft. Upper ends of table legs are pivotally connected to the shaft. Interspaced between arms and legs on the shaft are spacers and a tube through which the shaft passes. When a cap nut is secured on one end of the shaft and a knob is screwed onto threads at the other end of the shaft, arms and legs are pressed together preventing them from pivoting around the shaft and locking the table top in a chosen position of height and inclination. Springs connecting arms and legs bias arms to rise to a vertical position when the knob is loosened.

15 Claims, 7 Drawing Figures fig_1
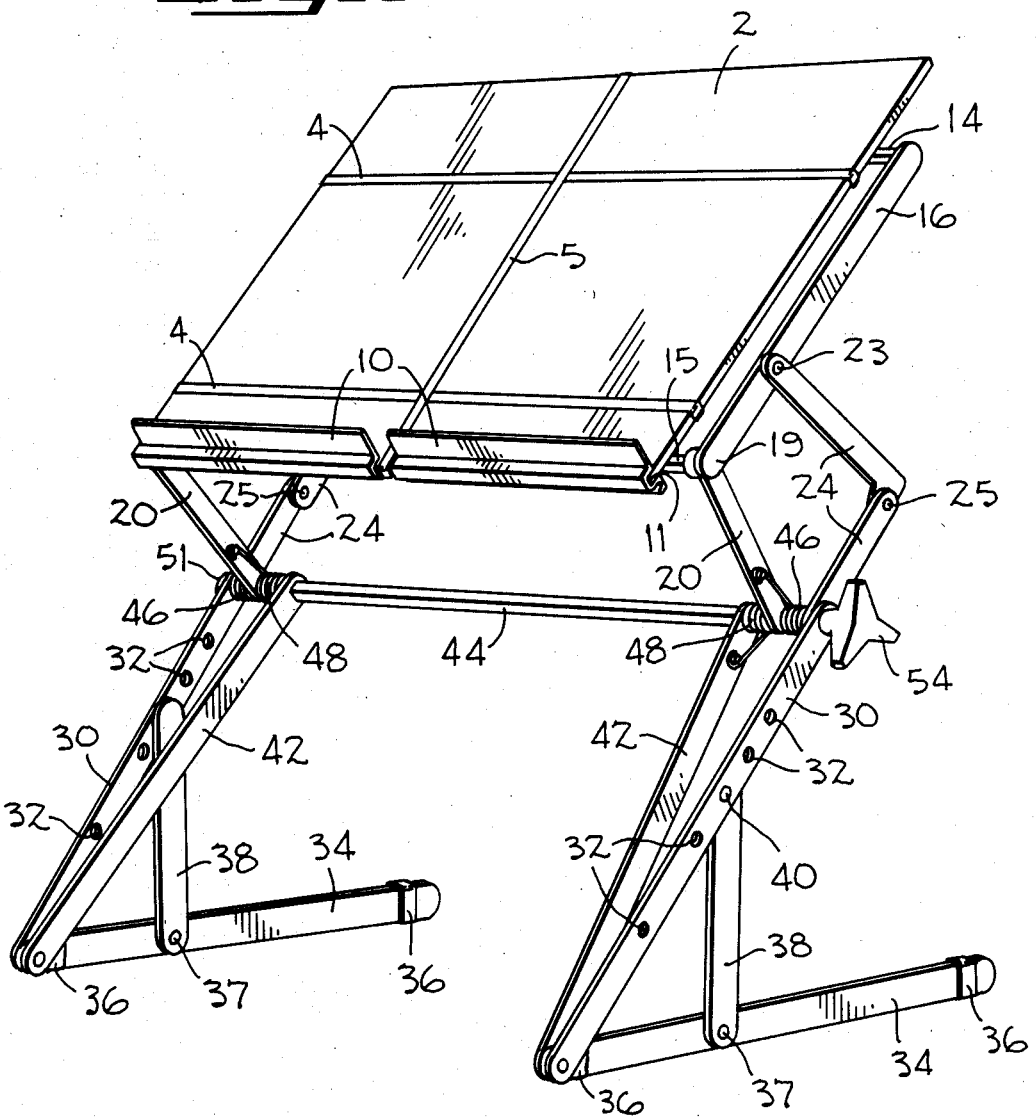
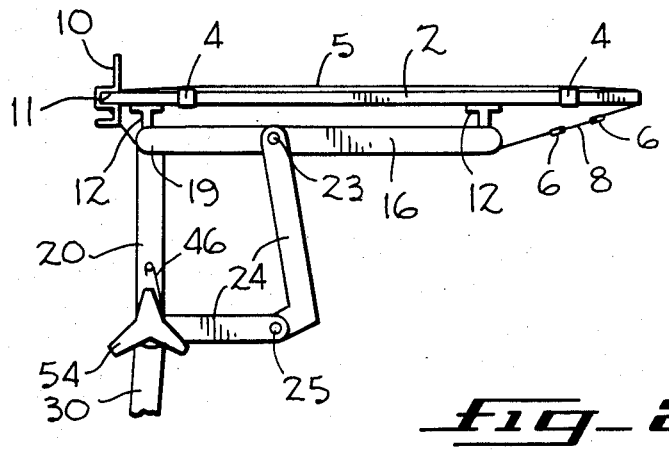
fig_2 fig-3
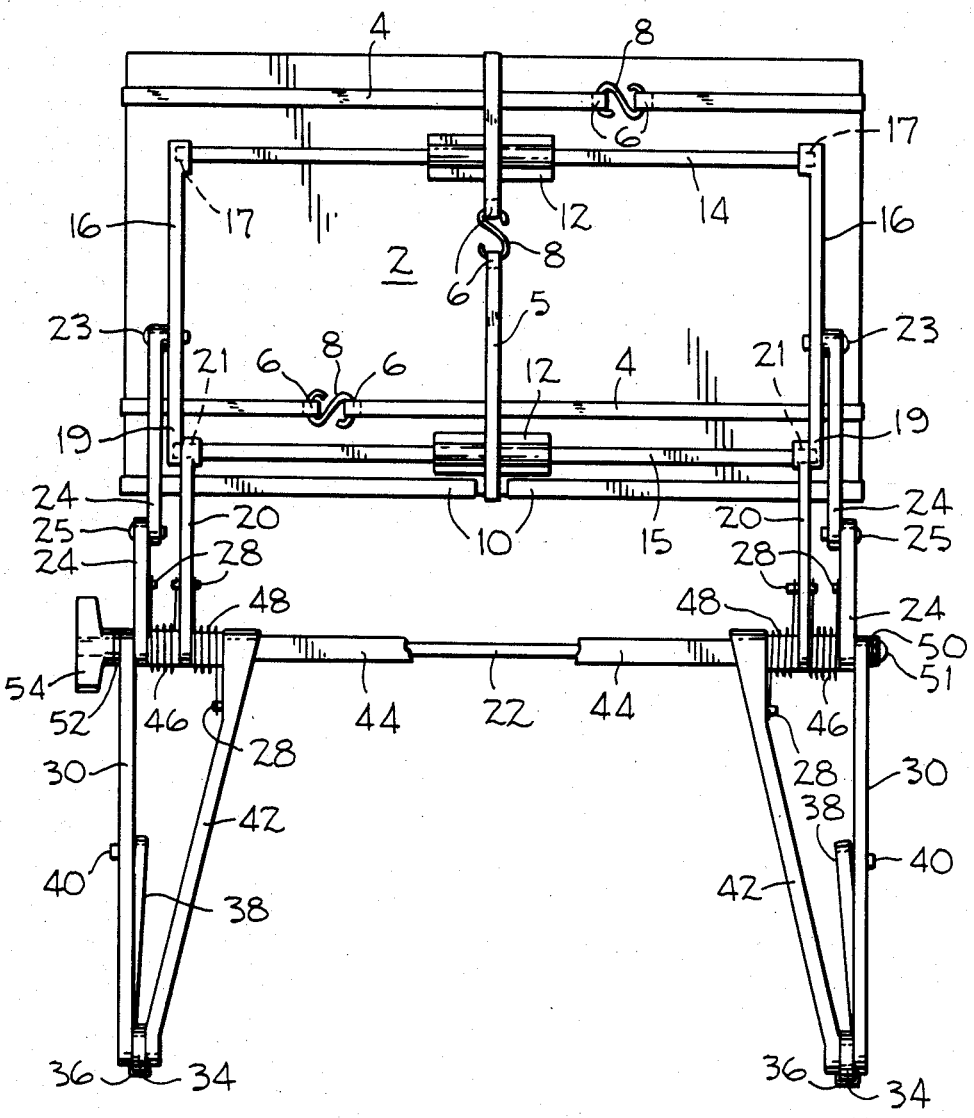
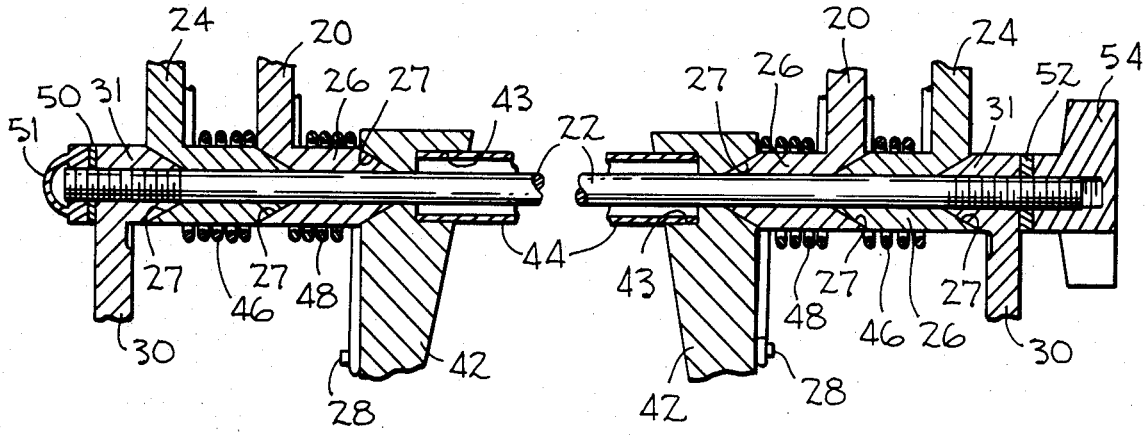
fig-4

HOLDER TABLE

BACKGROUND

The present invention is primarily designed for effortless movement of a book, magazine or papers to any desired position. Table top of the present invention adjusts up, down, left, right and to any angle 0°-180°. The top stays wherever placed thanks to spring balanced arms . . . or tightening a single knob locks the top in position for holding heavy loads. A Holder Table is used over lap or can hold a book over head for reading while reclining. Elastic straps are provided for holding pages of a book open and to keep them from arcing . . . and to hold a book on the table top when it is positioned over head. Lips which grip an edge of the table top are provided to keep a book or other article from sliding off the table top when it is not level. The unit folds up for carrying. The Holder/Table serves as a book holder, portable desk, food tray holder, drawing table, lectern, copy holder, music stand etc.

The above and other advantages of the present invention will no doubt become apparent after reading the following detailed description of the preferred embodiments which are illustrated in the figures of the drawing.

IN THE DRAWING

FIG. 1 is a front perspective view of a first species of the present invention.

FIG. 2 is a side elevation view of the upper part of a first species of the present invention.

FIG. 3 is a back elevation view of a first species of the present invention.

FIG. 4 is a detailed crosssection view showing the relationship of arms, legs, springs and spacer bosses around a shaft of a first species of the present invention.

DETAILED DESCRIPTION OF THE PREFERRED EMBODIMENTS

Figure 7:
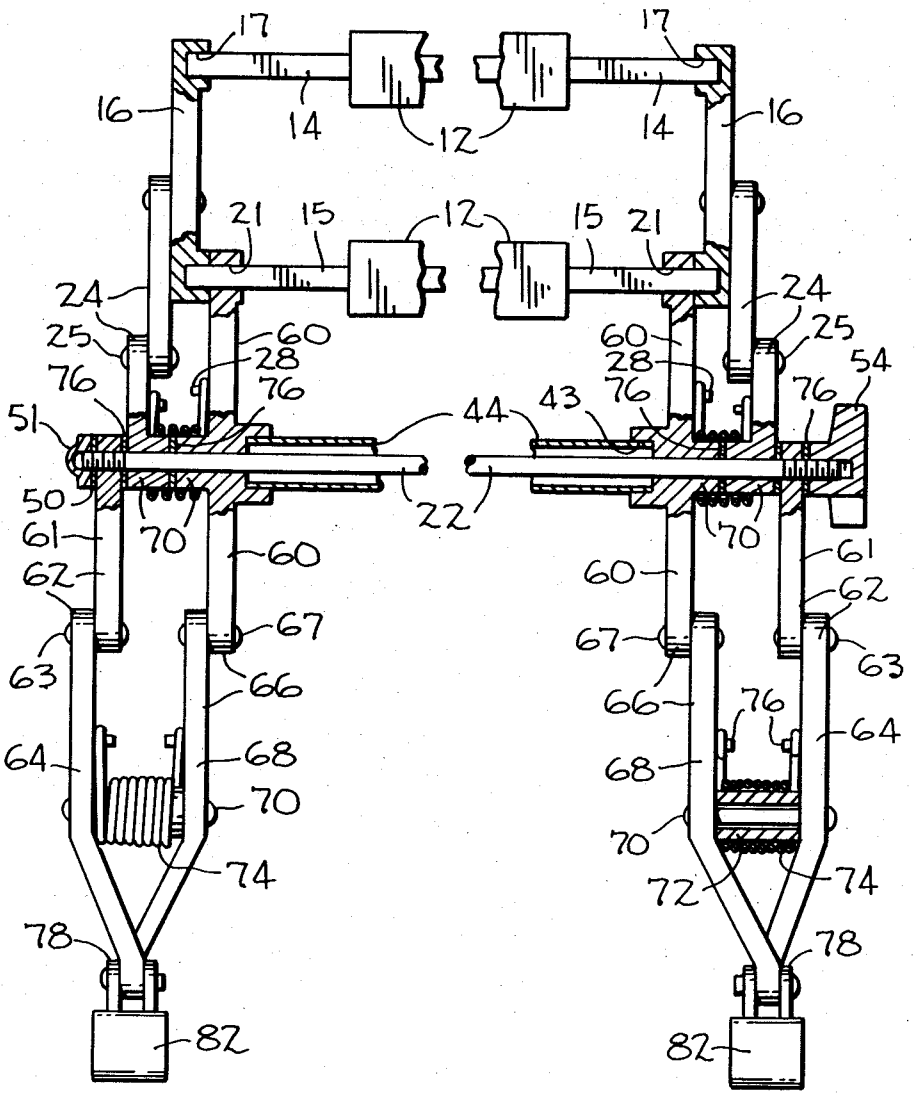
FIG. 7 is a front elevation view of a second species of the present invention with its table top removed.

FIGS. 1-4 illustrate a first species of the present invention.

Around opposite edges and across the front and back surfaces of a table top 2 are looped two elastic hold down straps 4. A third elastic hold down strap 5 is looped around straps 4 and the table top 2. At the ends of the elastic straps are small loops 6 in which ends of S-hooks 8 are inserted (FIG. 3). A strap can be removed from the table top by disconnecting an S-hook end from a strap loop 6.

Figure 6:
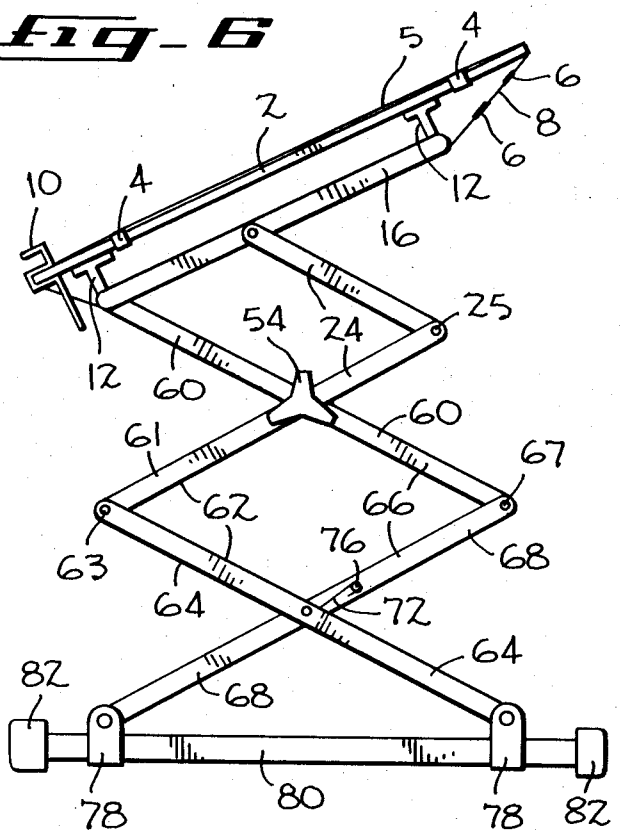
FIG. 6 is a side elevation view of a second species of the present invention.

Two lips 10 have a groove 11 which grips an edge of the table top. Lips 10 are reversable from high lip position (FIG. 1) to low lip position (FIG. 6). To change from a high to low lip, a lip is pulled off the table top edge, flipped over and pushed back on the edge. A low lip is used when writing, a high lip for other uses.

Secured to the backside of the table top are two slide brackets 12 (FIG. 5) which are slidably connected to rails 14 and 15. Rails 14 and 15 are square bars wih rounded corners which slidably fit in round holes through the length of slide brackets 12. A slide bracket 12 can both slide along and pivot around a rail. In order to enable the table top to slide smootly on rails 14 and 15, these rails must be held parallel to each other. The preferred means for doing this is to press fit ends of slide rail 14 in square blind holes 17 in ends of rail supports 16. Square holes 17 in rail supports 16 are oriented such that when opposite ends of a rail are pressed into them. rail supports 16 are held parallel to each other.

Opposite ends of rail 15 are press fit forced through square holes 21 in ends of single piece arms 20. Square holes in ends of arms 20 are oriented such that when opposite ends of a rail are pressed through them, arms 20 are held parallel to each other. A short length of rail 15 at each of its ends extends out from square holes 21 in arms 20. These rail ends pivotally fit in round blind holes in ends 19 of rail supports 16. This structure keeps rails parallel to each other as they are inclined, raised or lowered.

Single piece arms 20 are pivotally connected at their opposite ends to round shaft 22.

Pivotally secured at a point 23 along the length of each rail support 16 is an end of a two piece jointed arm 24 which pivots at a joint 25. Rivets are used to pivotally join the two pieces of a jointed arm 24 and to pivotally join an end of each jointed arm 24 to a rail support 16. The upper part of jointed arm 24 has a 90° bend at one end which allows the table to fold up more compactly than if this arm piece were straight. Jointed arms 24 are pivotally connected at their lower ends to shaft 22.

Single piece arms 20 have spacer bosses 26 with conical tips extending from their ends (FIG. 4). Jointed arms 24 also have spacer bosses 26 with conical tips extending from their ends. On the opposite side of arm ends with bosses are conical shaped hole entries 27. Male conical spacer boss tips nest in conical hole entries.

Upper ends of legs 30 are pivotally connected to shaft 22. Conical bosses 31 extend from upper ends of legs 30.

Legs 30 have peg holes 32 through them.

Pivotally connected to the lower end of each leg 30 is a foot 34. Latex bands 36 loop around ends of a foot nesting in grooves on sides of the foot and looping over top and bottom of ends of the foot to provide surface gripping glides which do not mar the surface on which the glides rest.

Pivotally connected by a rivet to foot 34 at a point 37 along its length is the end of a leg brace 38. At the oppossite end of the foot brace 38 extends a peg boss 40. Leg brace peg 40 fits into any of the leg peg holes 32. Legs of a Holder Table are set up by putting leg brace pegs 40 in opposite leg holes 32. The angle of a leg to foot, is adjustable according to which opposite pair of leg holes brace pegs are inserted.

The upper end of a leg-mate is pivotally connected to shaft 22. Hole entry on one side of the upper end of a leg-mate 42 is conical shaped and on its other sids is square shaped. The conical tip of a spacer boss 26 of an arm 20 nests in the conical shaped hole 27 on one side of a leg-mate and a square end of a square tube 44 nests in the square shaped hole entry 43 on the other side of each leg-mate. Square hole entries in leg-mates 42 are oriented such that when ends of square tube 44 are inserted in square holes in leg-mate ends, legmates 42 are held parallel to each other. It is important that opposite leg-mates (and therefore legs 30) be held parallel to each other as provided for by the square hole entry structure of the present invention. If legs are not held parallel it is difficult to get feet parallel so that they rest evenly on a flat surface.

Leg-mate 42 is pivotally connected by a rivet at its lower end to a foot 34 and a leg 30.

Arm-to-arm torsion springs 46 encircle the spacer bosses extending from the lower ends of jointed arms 24. One end of an arm-to-arm spring 46 is looped around a spring retainer boss 28 extending from an arm 24 and its other end around a spring retainer boss 28 extending from an arm 20. Arm-to-arm springs are formed such that loops at opposite ends of the spring wire are roughly parallel to each other when the spring is not under tension. Therefore an arm 20 is held roughly parallel to the lower part of arm 24 when there is no tension on spring 46. When tension is put on spring 46, it applies force to bring arm 20 back parallel to the lower part of jointed arm 24.

Arm-to-leg torsion springs 48 encircle the spacer bosses extending from the ends of arms 20. One end of an arm-to-leg spring 48 is looped around a spring retainer boss 28 extending from an arm 20 and its other end is looped around a spring retainer boss 28 extending from leg-mate 42. Arm-to-leg springs are formed such that loops at ends of the spring wire are roughly 165° apart when the spring is not under tension. Therefore an arm 20 is held at an angle of roughly 165° to leg-mate 42 when there is no tension on the spring 48. When tension is put on spring 48, it applies force to bring straight arm 20 back to an angle of 165° with leg-mate 42. It is noted that an arm-to-arm or arm-to-leg spring is either right-hand coiled or lefthand coiled. Opposite coiled lefthand and righthand springs are used for spring biasing opposite right and left arms and legs.

Shaft 22 is threaded on each end. A star washer 50 is slipped on and a cap nut 51 screwed onto one end of the shaft. A flat washer 52 is slipped on and a knob 54 is screwed onto the other end of the shaft. When knob 54 is tighteded, conical walls of arms and legs and ends of square tube 44 are pressed tightly together preventing these parts from pivoting around the shaft and locking the table top 2 in a chosen position of height and inclination. Arm and leg boss tips and hole entries are conical shaped because this structure provides a strong grip between walls when they are pressed tightly together. On the other hand, knob 54 can be loosened to reduce friction between conical walls such that it allows arms to be moved from one angular position to another and remain in the position placed. The springs counter balance the weight of upper table parts and a book or other article on the table top.

The height of the table top is adjustable both by adjustment of leg brace pegs 40 in leg peg holes 32 and by the angular adjustment of arms 20. The inclination of the table top is adjutable by the angular adjustment of rail support ends 19 around the rail held by arms 20 and is held in the inclination placed by jointed arms 24.

Figure 5:
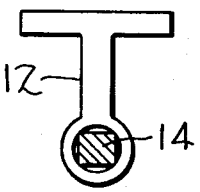
FIG. 5 shows details of a slide bracket.

Essential to the primary purpose of the present invention, which is to provide a book or magazine holder, are the elastic hold down straps. Pages of some books, particularly paper backs, and some magazines want to snap shut and their pages arc if not held down. To hold pages of an open book down flat, a book is placed on top of the straps, then the two straps 4 which loop around opposite edges of the table top are angled over one, two or more page corners as needed (FIG. 5). To turn a page when all four corners of an open book are held down, fingers of the right hand are pressed on the right-hand page then the hand is cupped to slide the page from under strap segments angled over corners to the righthand page. The page is turned and page corners are slipped under strap segments angled over the lefthand page corners. The third or center strap 5 serves to hold the other two straps 4 down on the table top surface when they are angled over book corners. The straps may also be used in other ways to hold papers or other articles on the table top surface.

The table top is slid right to read the lefthand colun of a page or left to read the righthand column of a page.

Turning now to a second species of the present invention which is shown in FIGS. 6–7 of the Drawing:

Upper structure of the second species of the present invention including table top 2, hold down straps 4 and 5, lip 10 S-hooks 8, slide brackets 12, rails 14 and 15, rail supports 16 and jointed arms 24 may be identical to the first species of the invention described above.

Single piece arm 60 in Species II (FIG. 6) is the same in its upper structrue as arm 20 in Species I. However in Species II, arm 60 extends below shaft 22 to also serve as the upper part of jointed leg-mate 66.

On one side of arm/upper leg-mate 60 (FIG. 7) is a square hole 43 into which square tube 44 fits and from its other side extends a spacer boss 70 which has a flat (rather than conical) end. The spacer boss 70 extending from the lower end of a jointed arm 24 also has a flat (rather than conical) end surface. End sides of arm 24 and leg upper piece 61 which face each other are also flat.

As shown in FIG. 7, to increase friction between arms and leg members, abrasive gripping washers 76 are used. These washers, have rough surfaces on both sides. The abrasive surfaces of washers 76 act like a clutch to grip opposite flat end surfaces of arm and leg end sides when they are pressed tightly together by tightening knob 54.

The upper leg piece 61 of jointed leg 62 is pivotally connected at its upper end to shaft 22 and at its lower end is pivotally connected by a rivet at joint 63 to the upper end of the lower leg piece 64 of jointed leg 62.

The upper leg-mate element of arm/upper leg-mate piece 60 is pivotally connected to shaft 22 and at its lower end is pivotally connected by a rivet at joint 67 to the upper end of the lower leg-mate piece 68 of jointed leg-mate 66.

Lower leg piece 64 is pivotally connected at its midpoint to the midpoint of lower leg-mate piece 68 by a rivet7 0. Around rivet 70 is a spacer 72. Encircling spacer 72 is a leg-to-leg torsion spring 74. Ends of the torsion spring 74 are looped around spring retainer bosses 76 extending from lower leg and lower leg-mate pieces. A leg-to-leg-mate spring is formed such that loops at the opposite ends of the spring wire are roughly parallel to each other when the spring is not under tension. Therefore when tension is put on spring 74, it applies force to bring lower leg 62 and lower leg-mate 66 to a vertical position.

Below its midpoint 70, lower leg piece 64 angles to pivotally connect with a foot slide bracket 78 (FIG. 6) and below its midpoint 70, lower leg-mate piece 68 angles to pivotally connect with a foot slide bracket 78. Rivets are used to pivotally connect member 64 and 68 to foot slide brackets 78. Slide brackets 78 have holes through their length and slide on foot rails 80. The ends of foot rail 80 are force fit secured in blind holes in hard rubber foot tips 82.

Species II of the present invention has an advantage over Species I in that table leg height adjustments can be locked in position merely by turning a single knob 54.

Adjustment of brace pegs in peg holes is not necessary. However, Species I has a simpler leg structure.

It is noted that rather than screwing a knob onto the end of a shaft, a handle with an eccentric secured to it may be pivotally connected to the end of the shaft for pressing arms and leg ends tightly together. This structure is commonly used for locking drafting tables in the desired position.

It is believed apparent that the invention is not necessarily limited to the specific constructions illustrated and described, since such constructions are only intended to be illustrative of the principles of operation, it being considered that the invention comprehends any variations covered by basic principles disclosed.

What is claimed is:

1. A holder table comprising:

first and second parallel slide rails;

a table top slidably connected to said first and second parallel slide rails by a plurality of brackets;

first and second parallel rail supports, each of said rail supports having one end secured to said first slide rail and the other end pivotally connected to said second slide rail to form a frame; parallel first and second single piece arms, each of said single piece arms having one end secured to said second slide rail and the other end pivotably and slidably connected to a shaft;

parallel first and second two piece jointed arms, each of said jointed arms having one end pivotally and slidably connected to opposite ends of said shaft, said first jointed arm having its other end pivotably connected to said first rail support, said second jointed arm having its other end pivotably connected to said second rail support; a first and second leg, each leg being slidably and pivotally connected to opposite ends of said shaft;

parallel first and second leg mates, each of said leg mates being pivotally and slidably connected to opposite ends of said shaft; a tube through which the shaft passes being secured to said first and second leg mates for holding them parallel to each other;

locking means on the shaft for locking said first and second single piece arms, said first and second jointed arms, said first and second legs and said first and second leg mate in a selected orientation relative to the shaft.

2. The apparatus of claim 1 wherein said locking means consists of screwing a cap nut onto threads at one end of the shaft and a knob onto a threads at the other end of the shaft wherein when the knob is tightened, said single piece arms, said jointed arms, said legs and said leg mates are pressed together locking the table top in position.

3. The apparatus of claim 1 with the addition of at least one lip which has a groove which grips the edge of the table top.

4. The apparatus of claim 3 wherein the lip is high on one side of the groove and low on the other side of the groove.

5. The apparatus of claim 1 wherein two elastic hold down straps loop around opposite sides of the table top and a third elastic hold down strap loops around the other two straps and other two sides of the table top.

6. The apparatus of claim 1 including a first species of pivotal leg structure comprising two leg members and two leg-mate members wherein each leg is a single piece with peg holes through it and each leg-mate is a single piece and wherein said first leg and leg-mate are pivotally connected at their lower ends to a first foot and wherein said second leg and leg-mate are pivotally connected at their lower ends to a second foot and wherein to each foot at a point along its length is pivotally connected to an end of a foot brace and wherein at the other end of each foot brace extends a peg which fits in leg holes.

7. The apparatus of claim 6 wherein feet have glide bands around their ends.

8. The apparatus of claim 1 wherein a first and second arm-to-arm torsion spring each encircle a spacer and the shaft and wherein spring wire ends of the first arm-to-arm spring are connected to the first single piece arm and first jointed arm and spring wire ends of the second arm-to-arm spring are connected to the second single piece arm and second jointed arm and wherein table arms are biased to parallel each other when not under tension.

9. The apparatus of claim 1 wherein a first and second arm-to-leg torsion spring each encircle a spacer and the shaft and wherein spring wire ends of the first arm-to-leg spring are connected to the first single piece arm and the first leg-mate and wherein spring wire ends of the second arm-to-leg spring are connected to the second single piece arm and second leg-mate and wherein single piece arms are biased to rise to roughly a vertical position.

10. The apparatus of claim 1 including a second species of pivotal leg structure wherein each leg is comprised of two pieces which pivot at a joint and wherein each leg-mate is comprised of two pieces which pivot at a joint and wherein the midpoints of the lower pieces of the first leg and leg-mate are pivotally connected and the midpoints of the lower pieces of the second leg and leg-mate are pivotally connected and wherein the lower ends of the lower pieces of the first leg and leg-mate are pivotally joined to a first foot rail by foot slide brackets and the lower ends of the lower pieces of the second leg and leg-mate are pivotally joined to a second foot rail by foot slide brackets, and wherein a foot consists of a rail along which foot slide brackets slide.

11. The apparatus of claim 10 wherein each foot has rubber glides secured to its ends.

12. The apparatus of claim 10 wherein each one piece arm is secured to an upper leg-mate member.

13. The apparatus of claim 10 wherein two parallel lower leg members slide along the rails and the other two parallel lower leg members are secured to the rail.

14. The apparatus of claim 10 wherein around the rivets which pivotally join midpoints of the lower pieces of said first and second legs to leg-mates are spacers encircled by leg-to-leg-mate torsion springs and wherein one spring wire end of each leg-to-leg mate torsion spring is connected to a leg and its other end to a leg-mate wherein these torsion springs bias legs and leg-mates to rise roughly to a vertical position.

15. The apparatus of claim 1 wherein gripping washers are interspaced along the shaft between arm and leg members.

* * * * *